United States Patent [19]

Harrington

[11] 3,983,896

[45] Oct. 5, 1976

[54] UNDERGROUND VALVE ANTI-FREEEZE DEVICE

[75] Inventor: Charles L. Harrington, Southfield, Mich.

[73] Assignee: Wigma Corporation, Royal Oak, Mich.

[22] Filed: June 24, 1975

[21] Appl. No.: 589,937

[52] U.S. Cl. ..... 137/301; 251/214

[51] Int. Cl.[2] ..... E03B 9/08

[58] Field of Search ..... 137/272, 291, 292, 293, 137/301, 363–372; 251/214, 291, 292, 293

[56] References Cited

UNITED STATES PATENTS

| | | | |
|---|---|---|---|
| 724,741 | 4/1903 | Sandbo | 137/301 |
| 2,176,399 | 10/1939 | Garrett | 137/368 |
| 2,688,976 | 9/1954 | Baker | 137/301 X |

FOREIGN PATENTS OR APPLICATIONS

| | | | |
|---|---|---|---|
| 945,422 | 7/1956 | Germany | 137/363 |

*Primary Examiner*—Alan Cohan
*Assistant Examiner*—Richard Gerard
*Attorney, Agent, or Firm*—Harness, Dickey & Pierce

[57] ABSTRACT

An underground valve has an operating rod extending above the ground which may be rotated to shut the valve off or turn the valve on. Difficulty with freezing prevents the valve operation at certain times during the winter months and by having the rod located within an external protective tube and sealed therein by a cylindrical element which is rotatable with the rod relative to the tube, whereby the operating rod for the valve can always be rotated since no ground water can get into the tube which extends below the frost line and above the ground.

6 Claims, 3 Drawing Figures

UNDERGROUND VALVE ANTI-FREEEZE DEVICE

SUMMARY OF THE INVENTION

An anti-freeze device for the rotatably actuated underground valve which is operated to off and on position by a rod which extends from the valve below the frost line upwardly through a freezeable area to above the ground. A tube of metal, plastic, or other material extends over the operating rod which passes through a square hole in a cylindrical element which is sealed to the shaft and the tube by O-rings. The O-ring on the shaft assumes a square shape and is clamped by a compression plate which is secured to the top of the cylindrical element by a plurality of screws. The cylindrical element has grooves on the outer periphery near the top and bottom for the O-rings which seal the element to the interior surface of the tube. The bottom of the tube extends below the frost line while the top extends above the ground and since the cylindrical element is located so as to prevent ground water from rising within the tube above the frost level in the ground, the operating rod can always be rotated since no ground water can become frozen within the tube to prevent such rotation of the rod.

DESCRIPTION OF THE PREFERRED EMBODIMENTS

Figure 1:
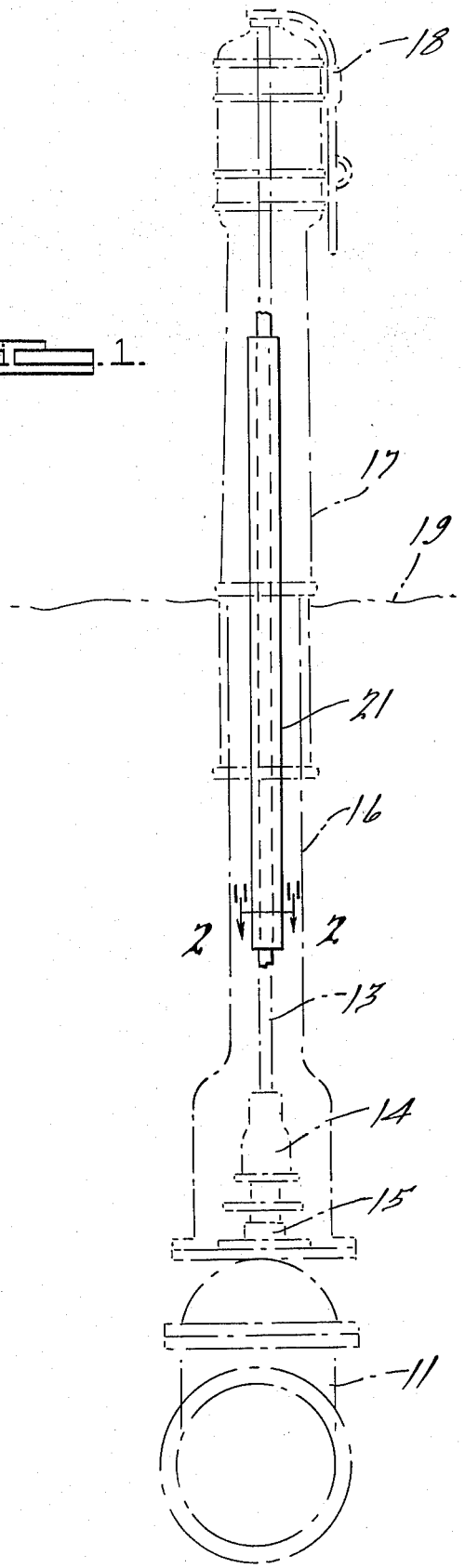
FIG. 1 is a view in elevation of an underground valve having an operating rod extending above the ground and sealed against freezing in a manner embodying features of the present invention.
Figure 2:
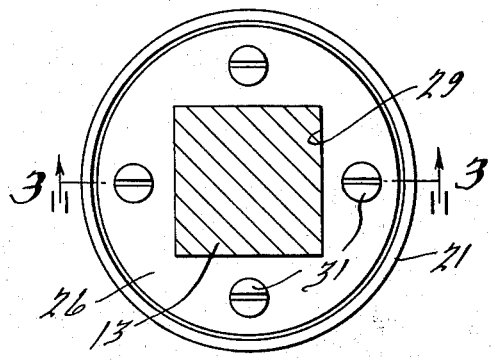
FIG. 2 is an enlarged sectional view of the structure illustrated in FIG. 1, taken on the line 2—2 thereof.
Figure 3:
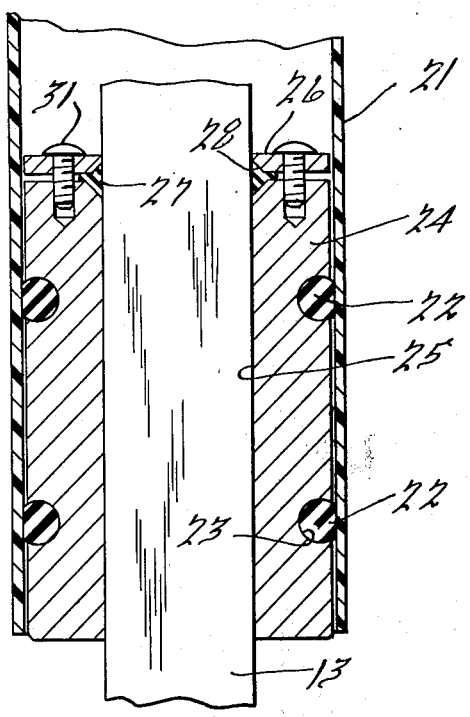
FIG. 3 is a sectional view of the structure illustrated in FIG. 2, taken on a line 3—3 thereof.

In the figures, a valve 11, such as that for water, is strategically employed in a water main where the valve is to be closed or opened. An operating rod 13 which is square in section is joined by a connector 14 to a valve shaft 15. The rod 13 is disposed within casing elements 16 and 17 and extends above the ground and is provided with an opening handle 18 connected to the top end of the rod 13. Difficulty is experienced when water enters the casing elements 16 and 17 and freezes below the ground level 19 which prevents the rod 13 from rotating. In the freezing area, a tube 21 is disposed over the rod 13 in engagement with O-rings 22 disposed in recesses 23 in a cylindrical element 24 which is of less diameter than the interior diameter of the tube 21. The cylindrical element has a square hole 25 through the center which snugly engages the rod 13 which is also of square cross section. A compression plate 26 has a central square hole 29 and is slid downwardly on the rod 13 in position to engage an O-ring 27 in notches 28 provided along the sides of the square openings 25 and 29 in the cylindrical element 24 and compression plate 26. A plurality of screws 31, herein illustrated as four in number, secure the compression plate 26 to the top end of the cylindrical element 24 with the O-ring 27 tightly engaging the rod 13 to provide a seal therewith as well as a securing force for retaining the cylindrical element 24 in a predetermined position on the rod 13. The rod is sealed to the cylindrical element 24 and the cylindrical element 24 is sealed to the inner surface of the tube 21 so that no ground water can enter the tube within the freezeable area of the ground, and therefore the operating rod 13 can always be rotated to shut off or open the valve.

I claim:

1. In an anti-freeze device for an operating rod of an underground valve, said rod having at least one flat side, a cylindrical element having at least one complementary flat side in a central opening through which the rod extends, a compression plate on said rod secured to the end of said cylindrical element, an O-ring about said rod which assumes the shape of the cross section thereof and which is compressed in sealed relation therewith when the compression plate is secured to the element, a tube about said rod disposed in the ground and extending from a position below the freezeable area thereof to a position above the ground level, and at least one O-ring in the outer wall of said cylindrical element in engagement with the innner surface of said tube which permits the element to be rotated with the rod.

2. In an anti-freeze device as recited in claim 1 wherein the cross section of the rod and central opening of the element is square.

3. In an anti-freeze device as recited in claim 1 wherein facing notches are provided in the central opening in the element and plate in which the O-ring about the rod is compressed when the plate is secured to the adjacent end of the element.

4. In an anti-freeze device as recited in claim 3 which includes securing means in the form of a plurality of screws passing through holes in the plate and secured in threaded apertures in the end of the element.

5. In an anti-freeze device as recited in claim 1 wherein the compression of the O-ring between the plate and element provides a securing force for axially affixing the element to the rod.

6. In an anti-freeze device as recited in claim 1 wherein a notch is provided in the peripheral surface of the element adjacent to the top and bottom thereof in which the O-rings are supported in sealed relation to the inner wall of the tube.

* * * * *